United States Patent [19]

Imhoff

[11] Patent Number: 4,544,216

[45] Date of Patent: Oct. 1, 1985

[54] AUTOMATICALLY RELEASABLE LOCKING ELECTRIC PLUG

[76] Inventor: Robert W. Imhoff, 2062 Hanscom Dr., So. Pasadena, Calif. 91030

[21] Appl. No.: 616,948

[22] Filed: Jun. 4, 1984

[51] Int. Cl.[4] ..... H01R 13/629

[52] U.S. Cl. ..... 339/14 P; 339/45 M; 339/58; 339/74 R; 339/75 P; 339/267

[58] Field of Search ..... 339/14 P, 58, 74 R, 339/75 A, 75 M, 75 P, 267, 45 R, 45 M

[56] References Cited

U.S. PATENT DOCUMENTS

| | | | |
|---|---|---|---|
| 2,005,441 | 6/1935 | Shearer | 339/74 R |
| 2,261,615 | 11/1941 | Cornwell | 339/74 R |
| 2,947,966 | 8/1960 | Francis et al. | 339/58 |
| 3,890,025 | 6/1975 | Gray | 339/75 P |
| 4,274,697 | 6/1981 | Dodge et al. | 339/14 P |
| 4,313,148 | 1/1982 | Turner | 339/14 P |

FOREIGN PATENT DOCUMENTS

| | | | |
|---|---|---|---|
| 554214 | 1/1957 | Italy | 339/74 R |

*Primary Examiner*—John McQuade

*Attorney, Agent, or Firm*—Poms, Smith, Lande & Rose

[57] ABSTRACT

To hold a plug and socket together, a three-prong plug including two active prongs and a grounding prong is provided with an additional locking member which is recessed into the grounding prong. The grounding prong on the male portion of the plug has a V-shaped or U-shaped cross-section with the two sides of the electrical prong coming together with a ramp configuration at the outer end of the prong. An elongated locking member is mounted for longitudinal movement within the cross-sectional configuration of the grounding prong, with the outer end of the locking member engaging the ramp when the locking member reaches its extreme outer position to force the locking member transversely out of the recess within the U-shaped or V-shaped configuration of the third prong and into engagement with a portion of the mating female prong. In addition, arrangements are provided for normally biasing the locking member toward the outer end of the grounding prong; and release arrangements are secured to the male plug and in engagement with the locking member for unlocking the locking member and concurrently by moving the release member in a single direction for pulling the two plugs apart.

10 Claims, 4 Drawing Figures

AUTOMATICALLY RELEASABLE LOCKING ELECTRIC PLUG

FIELD OF THE INVENTION

This invention relates to electrical plugs and more particularly to arrangements for locking male and female electrical plugs in engagement with one another.

BACKGROUND OF THE INVENTION

It has previously been proposed to provide arrangements for locking electrical connectors together, once the male and female plugs are in engagement with one another. One such arrangement is disclosed in G. L. Gray, U.S. Pat. No. 3,890,025 granted June 7, 1975, wherein the grounding plug for a three-terminal plug is formed in two parts, and a camming member is rotated to separate the two parts and force them into lateral engagement with the mating female receptacle. However, this is a relatively complex arrangement and requires separate operation of the locking element to release the plug prior to pulling the two plugs apart.

Accordingly, an important object of the present invention is to provide a simpler locking arrangement, and one in which the unlocking step occurs naturally as the two plugs are pulled apart, with a single motion.

SUMMARY OF THE INVENTION

A system for holding an electrical plug into a mating socket includes a male plug having first and second active connector prongs and a third larger grounding prong. A locking member is slidably mounted within the grounding prong, and is spring biased toward the outer end of the grounding prong and into locking engagement with adjacent portions of the mating female plug. Releasing arrangements are provided for pulling the locking member away from the outer end of the grounding prong to release the two plugs, with the releasing arrangements being actuated in the direction for separation of the plugs so that further movement in the same direction separates the two plugs.

In a preferred embodiment of the invention the grounding prong may be U-shaped or V-shaped in cross section and may have a ramp between the two sides of the cross section of the prong at the outer end of the prong, whereby the locking member is forced laterally outward by the ramp in the course of longitudinal movement of the locking member toward the outer end of the grounding prong, and is thereby forced into engagement with the mating plug.

The male plug may have a cap which is slidably mounted relative to the main body of the male plug and which engages the locking member. Accordingly, with the locking member normally being spring-biased into its locking position toward the end of the grounding prong, outward pressure on the cap will initally move the locking member and release the engagement with the mating plug, and further pulling on the cap member will separate the two plugs.

An important advantage of the present invention is its simplicity, and the fact that with a single motion involving the shifting of the locking member away from the end of the grounding prong and away from the mating female connector, a two-step release is accomplished with movement always occurring in a single direction, first releasing the interlock and subsequently separating the plugs.

Other objects, features and advantages of the invention will become apparent from a consideration of the following detailed description and from the accompanying drawings.

DETAILED DESCRIPTION

Figure 1:
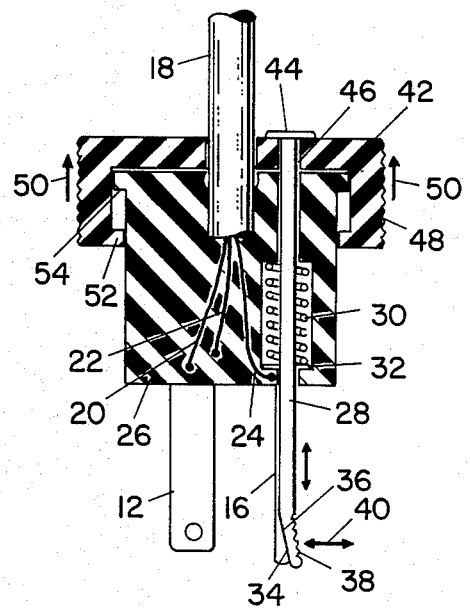
FIG. 1 is a partially diagrammatic transverse cross-sectional of a plug illustrating the principles of the present invention.
Figure 2:
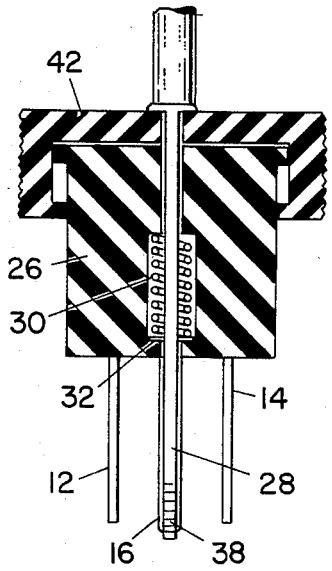
FIG. 2 is a schematic cross-sectional view similar to that of FIG. 1 but taken at right angles to the view of FIG. 1.
Figure 3:
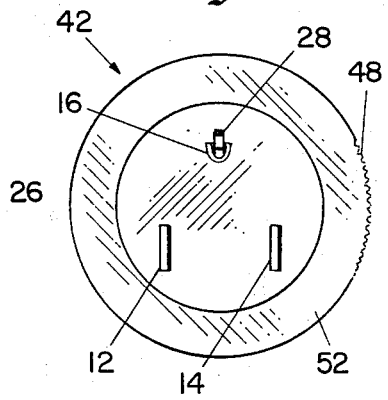
FIG. 3 is an end view of the male plug of FIGS. 1 and 2 taken from the end of the plug where the prongs are located.

Referring more particularly to the drawings, FIGS. 1, 2 and 3 are different views of a three-conductor or three-prong plug, showing the two active conductors 12 and 14 and the grounding conductor, or prong 16. The wire 18 contains three conductors, including two active conductors 20 and 22 shown schematically in FIG. 1 connected to the active conductors 12 and 14, respectively; and the grounding lead or conductor 24 connected to the grounding connector or prong 16 of the three-terminal plug. The body 26 of the plug is merely shown schematically, as the physical configuration of the active conductors 12 and 14 and their interconnections to the conductors in the cable or wire 18 may take any of a number of forms.

Associated with the grounding connector 16 is an elongated locking member 28 mounted for vertical movement within the U-shaped or V-shaped cross-sectional configuration of the grounding member 16. The locking member 28 is normally spring-biased by the spring 30 bearing on the pin 32, which is secured to member 28, to the extended position of member 28 as indicated in FIG. 1. At the lower end of the V-shaped or U-shaped grounding conductor 16 is a ramp 34 upon which the slanted surface 36 at the outer end of the locking member 28 bears. Accordingly, when the spring 30 forces the locking member 28 downwardly, as indicated in FIG. 1, the lower end of the locking member 28 and particularly the roughened exposed portion 38 is forced outwardly away and beyond the fixed portion 16 of the grounding terminal, as indicated by the double headed arrow 40. As the locking member 28 extends out laterally from the grounding prong 16, it engages a portion of the mating female connector into which the male connector of FIGS. 1 through 3 is plugged. This prevents inadvertent unplugging of the connectors, for example, when a power tool is employed or when a vacuum cleaner may be in use, and some pressure is applied to the cord toward unpluging it.

A cap 42 is mounted on the body 26 of the male plug of FIGS. 1 through 3, and the locking member 28 is provided with a head 44 which extends through an opening 46 in the cap 42. When the cap 42 is gripped by its serrated peripheral surface 48 and moved in the direction of the arrows 50 (see FIG. 1) the locking member 28 will be moved inwardly away from the end of the prong 16, so that the slanted surface 36 at the outer end of the locking member 28 no longer engages the ramp 34, and the locking member 26 may be fully recessed within the U-shaped or V-shaped cross-sectional configuration of the fixed portion of the grounding conductor 16. With further movement of the cap 42 in the direction of the arrows 50, the flange 52 on the cap 42 will engage the shoulder 54 on the main body 26 of the male plug, and positive force is applied to separate all three conductors or prongs 12, 14 and 16 from the mating female plug. It may particularly be noted that a single movement of the cap 42 in the direction of the arrows 50 serves to both initially release the locking member 28, and then complete the separation of the two plug members.

The locking member 28 may be made of any suitable material such as high strength plastic, or metal. It is preferable that the serrations 38 be such as will not permanently damage any mating structures. In this regard, the serrations 38 may be formed of high strength plastic material and to increase friction, some rubbery substance, either threads thereof, or an impregnation or coating may be employed. Alternatively, if no adverse affects result therefrom, the locking member 28 may be formed of metal, preferably with a suitable rubbery or other coating on the serrations 38.

Figure 4:
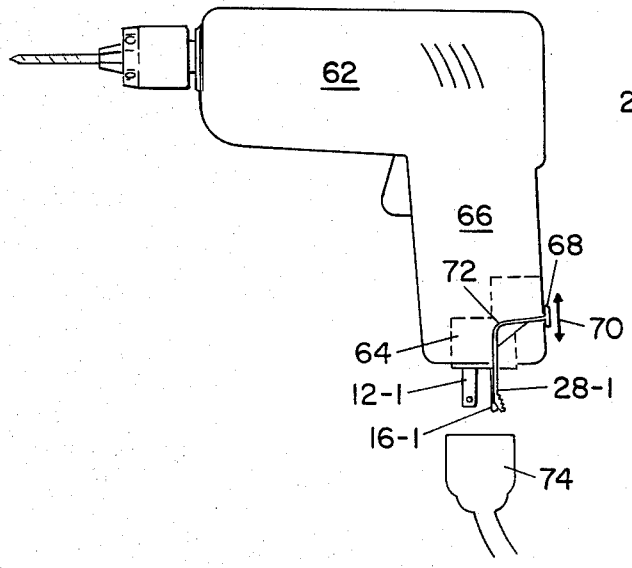
FIG. 4 is a diagrammatic showing of a modified form of the invention as applied to the electrical connections for a power drill.

FIG. 4 shows an alternative embodiment of the invention in which the plug is associated with a power drill 62. More specifically, the male plug assembly 64 may be mounted in the base of the handle of the power drill 62, with the prongs 12-1, 16-1, and the third prong, extending downwardly from the base of the handle 66 of the power drill 62, substantially as shown. A locking member 28-1 may be provided to serve substantially the same function as the locking member 28 of FIGS. 1 through 3. As in the case of the element 28 of FIGS. 1 through 3, the locking member 28-1 of FIG. 4 may be spring-biased toward the outer end of the grounding connector or prong 16-1. The locking member 28-1 may be connected to a slidable release button 68 which is mounted at the rear of the handle 66 for movement as indicated by the double headed arrow 70. The locking mechanism 28-1 may be reinforced by sheet material 72 which may be associated with the member 28-1 to prevent the bending thereof. In practice, when it is desired to release the power drill 62 from the female connector 74, the handle 66 of the power drill 62 is gripped with one's thumb engaging the release button 68 and pushing it upwardly. When this is accomplished, the locking member 28-1 is retracted, and the female plug 74 is then released and may be pulled away from the male plug assembly embedded in the bottom of the handle 66.

Incidentally, it is to be understood that the grounding member 16 is normally of U-shaped or V-shaped configuration, with the showing of FIG. 1 having the sidewall of the member 16 being cut away on the side facing the viewer more clearly depict the ramp action, as discussed in detail above.

In conclusion, it is to be understood that the figures of the drawings and the foregoing detailed description illustrate one preferred embodiment of the invention. Variations of the particular mechanical design as shown and described above are within the scope of the invention. Thus, by way of specific example, and not of limitation, instead of using the coil spring 30, a leaf type biasing spring could be used, and instead of the cap member 42, a heavy ring may be secured to the upper end of the locking member 28 so that, following withdrawal and release of the locking member 28, the ring could pull the entire assembly apart. The present invention is therefore not limited to the specific forms shown in the drawings and described in detail hereinabove.

What is claimed is:

1. A system for holding an electrical plug into a mating socket comprising:

a male plug including first and second active connector prongs; and a third grounding prong having a substantial U-shaped or V-shaped cross section, with the two sides of the cross section of the prong coming together with a ramp configuration at the outer end of said third prong;

an elongated locking member;

means for mounting said elongated locking member for longitudinal movement within the V-shaped configuration of said third prong, with the outer end of said locking member engaging said ramp when said locking member reaches its extreme outer position, to force the locking member transversely out of the recess within said V-shaped configuration of said third prong;

means for normally biasing said locking member toward the outer end of said third prong to force said locking member into locking engagement with adjacent structure of a mating socket; and release means secured to said male plug and engaging said locking member for retracting said locking member from said ramp and unlocking the male plug from any associated mating socket.

2. A system as defined in claim 1 wherein said release means includes means for engaging the main body of said male plug, whereby outward force applied to said release means initially disengages said locking member, and subsequently completely separates said male plug from any associated mating socket with which it has been in contact.

3. A system as defined in claim 1 wherein the side of said locking member facing away from said grounding prong is serrated.

4. A system as defined in claim 1 wherein the side of said locking member facing away from said grounding prong is provided with means for engaging a mating socket.

5. A system for holding an electrical plug into a mating socket comprising:

a male plug including first and second active connector prongs; and a third grounding prong having a substantially greater cross section than said first and second prongs;

an elongated locking member;

means for mounting said elongated locking member for longitudinal movement within the configuration of said third prong, and for causing locking engagement with an adjacent mating female socket when said locking member reaches its extreme outer position;

means for normally biasing said locking member toward the outer end of said third prong in its locking position;

release means secured to said male plug and engaging said locking member for pulling said locking member awey from the end of said third prong and unlocking the male plug from any associated mating socket; and said system including means for forcing said locking member transversely away from said grounding prong when said locking member reaches its extreme outer position.

6. A system as defined in claim 5 wherein said release means include means for engaging the main body of said male plug, whereby outward force applied to said release means initially disengages said locking member, and subsequently completely separates said male plug from any associated mating socket with which it has been in contact.

7. A system as defined in claim 5 further comprising a power tool, and wherein said male plug is mounted in said power tool.

8. A system for holding an electrical plug into a mating socket comprising:

an electrical appliance;

a male plug mounted onto said electrical appliance, said male plug including first and second active connector prongs; and a third grounding prong having a substantially greater cross section than said first and second prongs;

an elongated locking member;

means for mounting said elongated locking member for longitudinal movement within the configuration of said third prong, and for causing locking engagement with an adjacent mating female socket when said locking member reaches its extreme outer position;

means for normally biasing said locking member toward the outer end of said third prong in its locking position;

release means secured to said electrical appliance and engaging said locking member for pulling said locking member away from the end of said prong and unlocking the male plug from any associated mating socket; and said system including means forcing said locking member transversely away from said grounding prong when said locking member reaches its extreme outer position.

9. A system as defined in claim 8 wherein the side of said locking member facing away from said grounding prong is provided with means for engaging a mating female socket.

10. A system for holding an electrical plug into a mating socket comprising:

an electrical appliance;

a male plug mounted onto said electrical appliance, said male plug including first and second active connector prongs; and a third grounding prong having a substantially greater cross section than said first and second prongs;

an elongated locking member;

means for mounting said elongated locking member for longitudinal movement within the configuration of said third prong, and for causing locking engagement with an adjacent mating female socket when said locking member reaches its extreme outer position;

means for normally biasing said locking member toward the outer end of said third prong in its locking position;

release means secured to said electrical appliance and engaging said locking member for pullung said locking member away from the end of said prong and unlocking the male plug from any associated mating socket; and the side of said locking member facing away from said grounding prong being serrated.

* * * * *